US006041441A

United States Patent [19]

Counts et al.

[11] Patent Number: 6,041,441

[45] Date of Patent: Mar. 28, 2000

[54] ATHLETIC TROUSERS

[76] Inventors: Paulette M. Counts, 4235 Portsmouth, Bridgeport, Mich. 48722; Patricia J. Hopp, 6266 Becker Rd., Saginaw, Mich. 48601

[21] Appl. No.: 09/082,016

[22] Filed: May 20, 1998

[51] Int. Cl.[7] ..... A41D 1/08

[52] U.S. Cl. ..... 2/227; 2/228; 2/404; 450/150; 602/71; 602/72

[58] Field of Search ..... 2/227, 228, 238, 2/455, 456, 466, 465, 69, 404, 407, 400, 22, 23, 403; 450/114, 150; 602/70–72

[56] References Cited

U.S. PATENT DOCUMENTS

| | | | |
|---|---|---|---|
| 1,573,212 | 2/1926 | Whitley et al. | 2/227 |
| 2,629,094 | 2/1953 | Goldsmith | 2/227 |
| 2,702,545 | 2/1955 | Orr | 128/159 |
| 3,654,634 | 4/1972 | Torres | 2/224 |
| 3,788,314 | 1/1974 | Noreen | 128/159 |
| 3,887,968 | 6/1975 | Lyman | 24/266 |
| 4,660,554 | 4/1987 | Wright | 128/158 |
| 4,811,427 | 3/1989 | Regan | 2/227 |
| 5,131,100 | 7/1992 | Atwater et al. . | |
| 5,161,257 | 11/1992 | Arensdorf et al. | 2/22 |
| 5,210,877 | 5/1993 | Newman | 2/227 |
| 5,365,610 | 11/1994 | Lubahn et al. | 2/227 |
| 5,497,511 | 3/1996 | Zade | 2/22 |
| 5,689,836 | 11/1997 | Fee et al. | 2/465 |
| 5,819,323 | 10/1998 | Edenfield | 2/466 |

OTHER PUBLICATIONS

*Road Runner Sports* catalog, Men's Apparel p. 17.

Eastbay Catalogue"Mizuno Sliding Compression Short", p. 97. Feb. 1997.

*Primary Examiner*—John J. Calvert
*Assistant Examiner*—Tejash Patel
*Attorney, Agent, or Firm*—Reising, Ethington, Barnes, Kisselle, Learman & McCulloch, P.C.

[57] ABSTRACT

The athletic compression trousers have an elastic waistband, a pair of tubular legs made from a stretchable fabric, a rear crotch panel and a front crotch panel. Belt loops may be attached to the outer surface of the elastic waistband. A waist cord can be provided in a waist cord passage in the waistband. A male support pocket is formed in the lower portion of the front crotch panel. A liner for the male support pocket has an upper opening for the insertion of a cup protector. Hip protection fabric side panels are sewn to either the inside or the outside of each tubular leg. These panels provide padding and protection. If needed, the fabric side panels can have openings for the insertion of hip protection pads.

12 Claims, 2 Drawing Sheets

20
32
88
14
92
16
86
12
90

62
18
72
68
64
70
66

20
32
18
48
46
76
78
24
22
50
74
72
86
88
92
14
12
90

ATHLETIC TROUSERS

FIELD OF THE INVENTION

This invention relates to athletic trousers and more particularly to male athletic trousers that provide compressive support of the abdomen, buttocks and upper leg muscles, and that have a crotch pocket that provides male support, reduces binding and eliminates the need to wear a separate supporter.

BACKGROUND OF THE INVENTION

Compression shorts that provide support for the muscles of the abdomen, buttocks, and upper leg muscles are well known. The shorts do not provide the proper male support to protect the testicles from injury and may, in fact, increase the chance and severity of injury to males.

A conventional athletic supporter can be worn under compression shorts. However, when this is done, the compression shorts interfere with the ability of the supporter to function properly and do its job, and causes binding and discomfort. The athletic supporter also interferes with the ability of the trousers to support the abdominal muscles and the straps on the supporter cause unsightly lines in the trousers.

SUMMARY OF THE INVENTION

An object of the invention is to provide trousers with a built-in crotch pocket for male support. Another object of the invention is to provide trousers which support the muscles of the buttocks, abdomen, and the upper legs. A further object of the invention is to provide trousers that reduce binding and improve comfort. A still further object of the invention is to provide trousers that eliminate the need for a separate athletic supporter.

The trousers comprise stretchable fabric that forms two tubular legs with upper ends secured to a waistband. A rear crotch panel is sewn to the waistband and to both tubular legs to enclose the rear of the trousers. A front crotch panel is provided with a support pocket with a seam in a generally vertical fore and aft plane. The front panel is sewn to the waistband, the rear crotch panel, and to both tubular legs to enclose the front of the trousers.

The length of the trouser legs is varied to form trousers with full length legs, trousers with intermediate length legs, or shorts.

A waist cord is provided in the waistband which can be tied, if desired, to hold the trousers up. Belt loops may also be provided.

A padding material panel is provided on each tubular leg to protect the wearer's hips. These panels can be attached on the inside or on the outside of the tubular legs. If required, the padding panels can be open at the top and form pockets for special protective pads.

The crotch pocket can be provided with an inside cover with an open top for the insertion of a protective cup of rigid material.

BRIEF DESCRIPTION OF THE DRAWINGS

The disclosed embodiment is representative of a presently preferred form of the invention, but is intended to be illustrative rather than definitive thereof. The invention is defined in the claims.

DESCRIPTION OF THE PREFERRED EMBODIMENT

Figure 2:
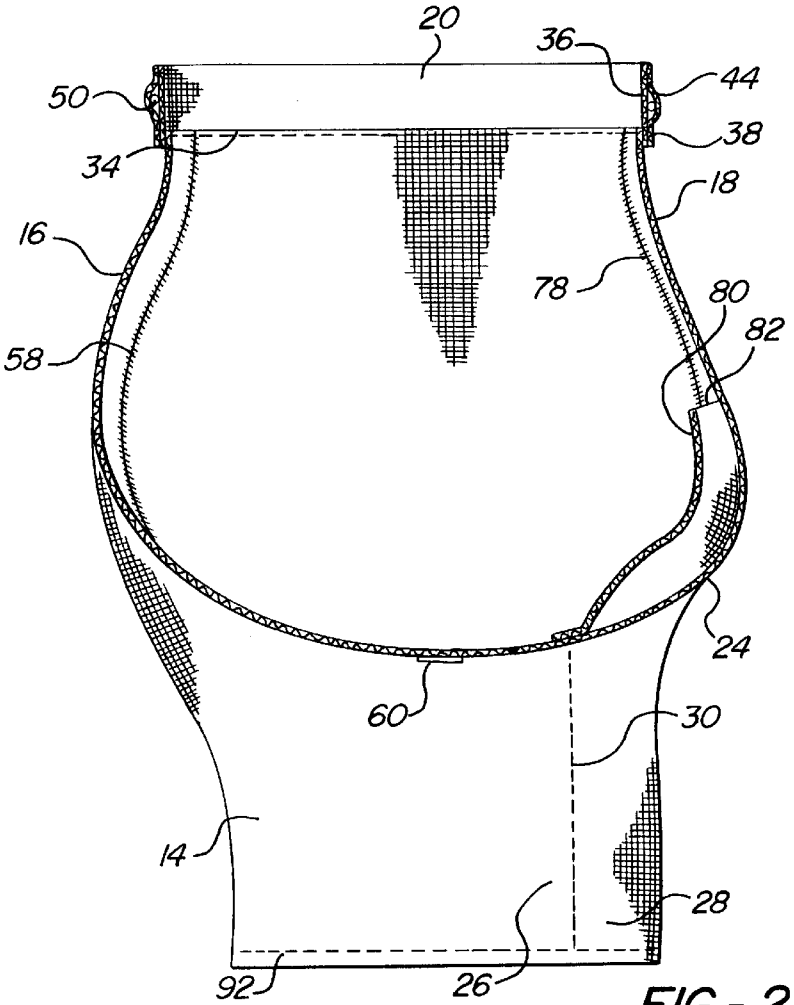
FIG. 2 is a sectional view taken along line 2—2 in FIG. 1.

The male athletic trousers generally designated by the reference number 10 include a right tubular leg 12, a left tubular leg 14, a rear crotch panel 16 and a front crotch panel 18. The upper ends of the right and left tubular legs 12 and 14, and both crotch panels 16 and 18, are sewn to a waistband 20. A seam 22 in the front crotch panel 18 forms a male support pocket 24.

Figure 1:
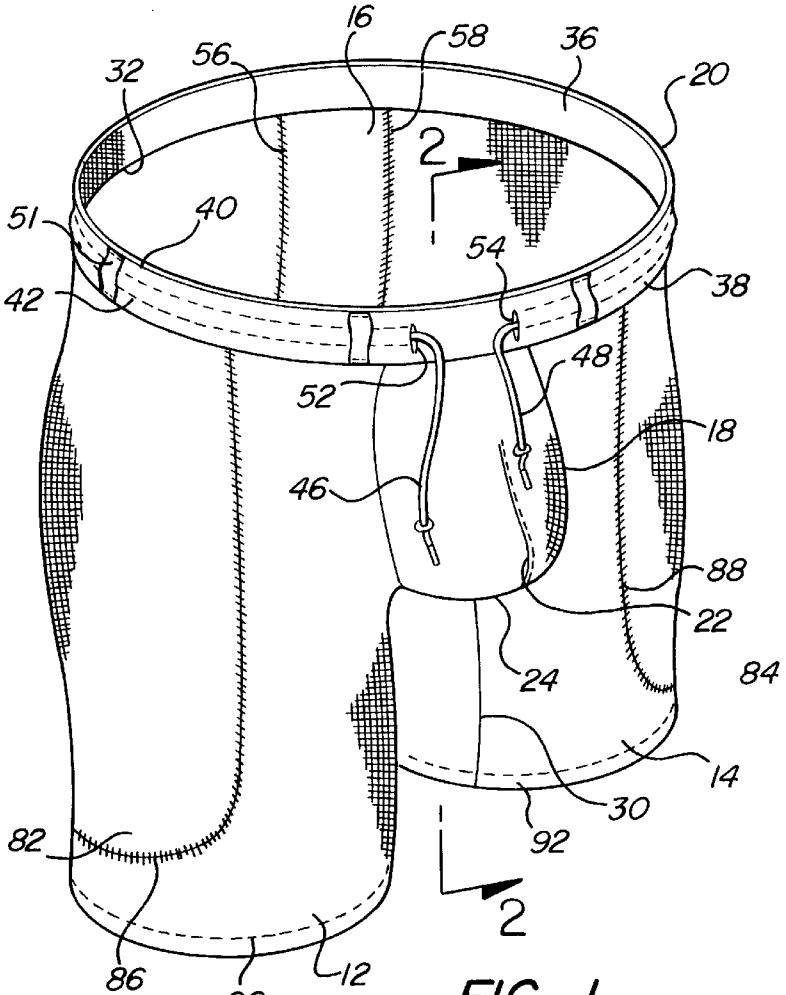
FIG. 1 is a perspective view of the trousers.

The tubular legs 12 and 14 are cut from flat fabric. Two edges 26 and 28 of each piece of the fabric are joined by a vertical seam 30 to form a tubular leg passage. As shown in FIGS. 1 and 2, the seams 30 are on the inside portion of wearer's legs. These vertical seams 30 could be in any desired location around a leg of a person wearing the trousers 10. It would also be possible to knit tubular legs 12 and 14 without seams 30.

Figures 3, 4, 5:
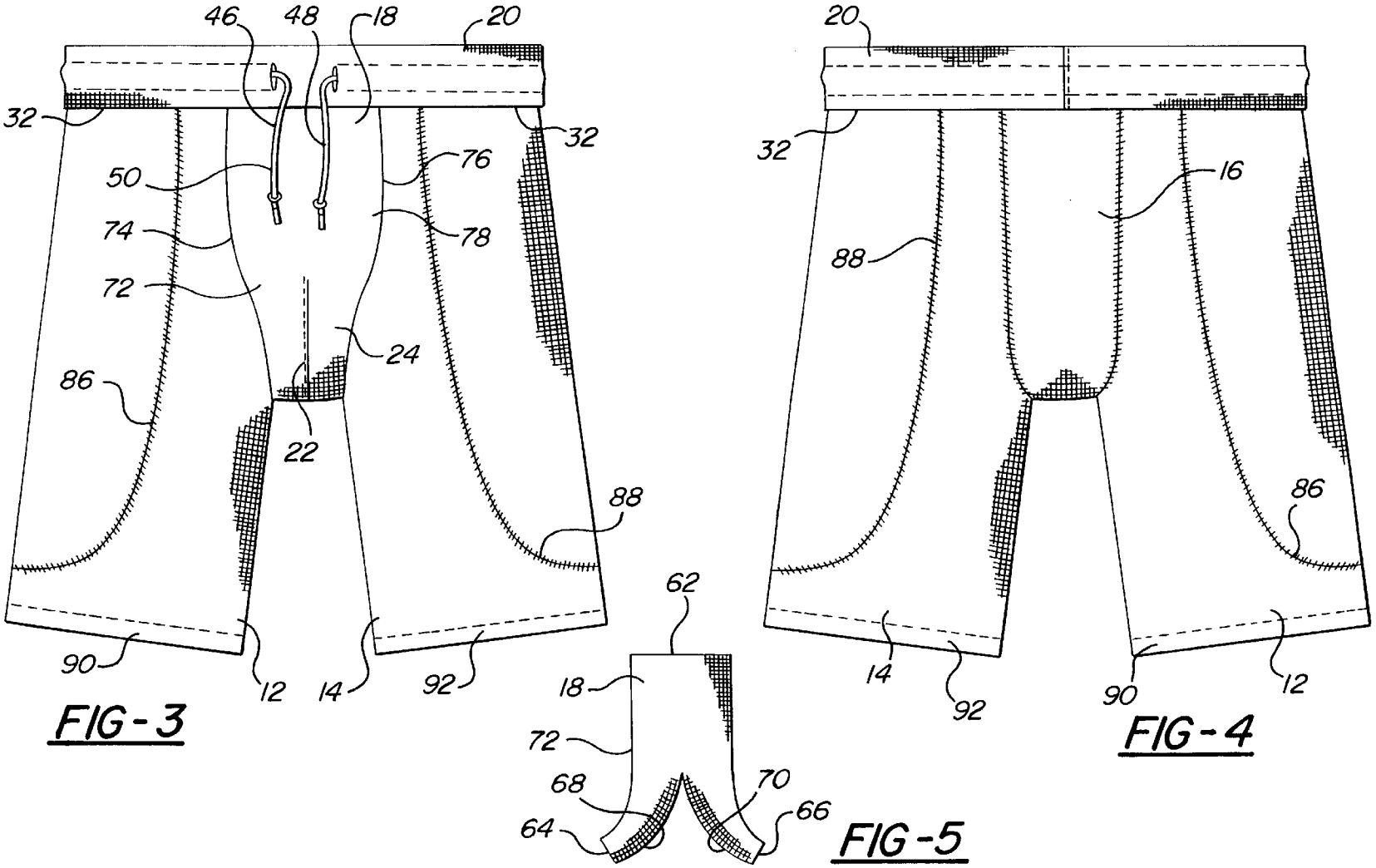
FIG. 3 is a front elevational view.
FIG. 4 is a rear elevational view.
FIG. 5 is a view of the front crotch panel before a seam is added to form a support pocket.

The top edges 32 of each of the tubular legs 12 and 14 are secured to the elastic waistband 20 by stitches 34. The elastic waistband 20 stretches to permit a person to pull the trousers 10 on or to take them off. The elastic waistband 20 also contracts to engage the waist of a person wearing the trousers 10 and hold the trousers up. The waistband 20 has an inner band 36 and an outer band 38 that are fastened to each other by stitches 40 and 42 that form a waist cord passage 44. As shown in FIGS. 1 and 3, the ends 46 and 48 of the cord 50 exit the passage 44 through openings 52 and 54 through the outer band 38. The ends 46 and 48 of the cord 50 are tied by the person wearing the trousers 10 to insure that the trousers are held up. The openings 52 and 54 could be through the inner band 36, if desired. With the openings 52 and 54 through the inner band 36, the cord 50 is concealed inside the trousers 10 when the ends 46 and 48 are tied. The cord 50 can be replaced or supplemented by belt loops 51 attached to the outer band 38 of the waistband 20, if desired. With belt loops, the wearer of the trousers 10 can elect to wear a belt when playing a contact sport.

The rear crotch panel 16 is attached to the right tubular leg 12 by stitches 56 and to the left tubular leg 14 by stitches 58. The rear crotch panel 16 has its upper end attached to the waistband 20 and its lower end attached to the front crotch panel 18 by a seam 60.

The front crotch panel 18 has an upper end 62 and lower ends 64 and 66. A generally V-shaped piece of material is removed from the panel 18 to form edges 68 and 70. The edges 68 and 70 are then joined by a seam 22 to form a male support pocket 24. The upper end 62 of the front panel 18 is attached to the waist band 20. A side 72 of the panel 18 is attached to the right leg 12 by stitches 74. Stitches 76 attach the side 78 of the panel 18 to the left leg 14. The lower ends 64 and 66 of the front panel 18 are attached to the rear crotch panel 16 by a seam 60 as described above.

A liner 80 for the support pocket 24 can be attached to the inside portion of the front crotch panel 18 as shown in FIG. 2. The liner 80 is made from a soft material to provide additional comfort. An opening 81 at the top of the liner 80 permits a cup protector to be inserted into the support pocket 24 and held in the pocket. Rigid cup protectors are commonly employed when participating in sports in which groin area injuries can occur.

Side panels 82 and 84 may be attached to the tubular legs 12 and 14 by stitches 86 and 88. The side panels 82 and 84 are second layers of fabric that reinforce the hip area of the trousers.

Side panels 82 and 84 made from a thick fabric, also provides some padding to protect the hip area of individuals participating in contact sports and other sports in which hip injuries may occur. These side panels 82 and 84 may be on the inside of the tubular legs 12 and 14 or on the outside. Openings 83 and 85 for the insertion of pads into the space between the side panels 82 and 84 and the legs 12 and 14 respectively, can be provided. Pads used adjacent to a person's hips can be soft or rigid, depending upon the sport the trousers are used for.

The tubular legs 12 and 14 of the trousers 10 can extend down to a person's ankles, to his knees, or they may be only a few inches long if the trousers are shorts. The bottom edge of the tubular legs 12 and 14 are turned up on the inside and sewn in place by stitches 90 and 92. A standard trouser cuff could also be provided at the bottom edge of each leg 12 or 14.

The disclosed embodiment is representative of a presently preferred form of the invention, but is intended to be illustrative rather than definitive thereof. The invention is defined in the claims.

We claim:

1. Athletic compression trousers comprising:

a continuous elastic waistband that encircles the waist of a wearer of the trousers and stretches to permit the trousers to be put on by the wearer or to be taken off by the wearer; two tubular legs of stretchable fabric with upper ends secured to the waistband and having tubular leg passages each of which is formed by a generally vertical seam on the inside portion of the wearer's legs; a front crotch panel with an upper end attached to the continuous elastic waistband, a right edge attached to the tubular leg for a right leg of the wearer, a left edge attached to the tubular leg for a left leg of the wearer, and a male support pocket formed in the front crotch panel by a seam that effectively removes a V-shaped piece of material from a portion of the front crotch panel; a liner for the male support pocket covering an inside surface of the front crotch panel and having an upper opening or insertion of a cup protector into the male support pocket; a right hip protection fabric side panel sewn to the tubular leg for the right leg of the wearer; and a left hip protection fabric side panel sewn to the tubular leg for the left leg of the wearer.

2. Athletic compression trousers as set forth in claim 1 wherein the right hip protection fabric side panel is sewn to the inside surface of the tubular leg for the right leg of the wearer and the left hip protection fabric panel is sewn to an inside surface of the tubular leg for the left leg of the wearer.

3. Athletic compression trousers as set forth in claim 2 wherein the right hip protection side panel forms a pocket and has a right protection pad opening, and the left hip protection side panel forms a pocket and has a left protection pad opening.

4. Athletic compression trousers as set forth in claim 1 including a waist cord passage in the waistband and a waist cord passing through the waist cord passage and having ends that exit the waist cord passage above the front crotch panel.

5. Athletic compression trousers as set forth in claim 1 including a rear crotch panel with an upper end attached to the continuous elastic waistband, a bottom edge attached to the front crotch panel and generally vertical edges attached to the adjacent tubular legs.

6. Athletic compression trousers as set forth in claim 1 wherein the right hip protection fabric side panel is sewn to and outside surface of the tubular leg for the right leg of the wearer, and the left hip protection fabric side panel is sewn to an outside surface of the tubular leg for the left leg of the wearer.

7. Athletic compression trousers as set forth in claim 1 including belt loops sewn to the outside of the continuous elastic waistband.

8. Athletic compression trousers as set forth in claim 1 wherein the two tubular legs both have a lower edge that is above a wearer's knee when being worn.

9. Athletic compression trousers comprising a continuous elastic waistband that encircles the waist of a wearer and stretches to permit the trousers to be put on or taken off; a right tubular leg of stretchable fabric with an upper edge secured to the continuous elastic waistband and a generally vertical seam joining two side edges to form a tubular right leg passage; a left tubular leg of stretchable fabric with an upper end secured to the continuous elastic waistband and a generally vertical seam joining two side edges to form a tubular left leg passage; a front crotch panel with an upper end attached to the continuous elastic waistband, a right edge attached to the right tubular leg, a left edge attached to the left tubular leg, and a male support pocket formed in the lower portion of the front crotch panel by a seam that effectively removes a V-shaped piece of material from the front crotch panel; a rear crotch panel with an upper edge attached to the continuous elastic waistband, a bottom edge attached to the front crotch panel, a right edge attached to the right tubular leg, and a left edge attached to the left tubular leg; a right hip protection fabric side panel sewn to the inside surface of the right tubular leg; a left hip protection fabric side panel sewn to the inside surface of the left tubular leg; and a liner for the male support pocket covering an inside surface of the front crotch panel and having an upper opening for the insertion of a cup protector into the male support pocket.

10. Athletic compression trousers as set forth in claim 9 including a right hip protection pad opening between the right tubular leg and the right hip protection fabric side panel, and a left hip protection pad opening between the left tubular leg and the left hip protection fabric side panel.

11. Athletic compression short trousers comprising a continuous elastic waistband that encircles the waist of a wearer and stretches to permit the trousers to be put on or taken off; a right tubular leg of stretchable fabric with an upper end secured to the continuous elastic waistband and a generally vertical seam joining two side edges to form a tubular right leg passage; a left tubular leg of stretchable fabric with an upper end secured to the continuous elastic waistband and a generally vertical seam joining two side edges to form a tubular left leg passage; a front crotch panel with an upper end attached to the continuous elastic waistband, a right edge attached to the right tubular leg, a left edge attached to the left tubular leg and a male support pocket formed in a lower portion of the front crotch panel by a seam that effectively removes a V-shaped piece of material from the front crotch panel; a rear crotch panel with an upper edge attached to the continuous elastic waistband, a bottom edge attached to the front crotch panel, a right edge attached to the right tubular leg, and a left edge attached to the left tubular leg; a right hip protection fabric side panel sewn to the inside surface of the right tubular leg; and a left hip protection fabric side panel sewn to the inside surface of the left tubular leg.

12. Athletic compression short trousers as set forth in claim 11 wherein the right tubular leg and the left tubular leg each have a lower edge that is above a wearer's knees when the short trousers are being worn.

* * * * *